United States Patent [19]

Brugman et al.

[11] Patent Number: 4,480,360

[45] Date of Patent: Nov. 6, 1984

[54] CLIP FOR WALL OR CEILING PANEL STRUCTURE

[75] Inventors: Johannes A. Brugman; Petrus J. Hennequin, both of Rotterdam, Netherlands

[73] Assignee: Hunter Douglas International N.V., Curacao, Netherlands Antilles

[21] Appl. No.: 452,437

[22] Filed: Dec. 23, 1982

[30] Foreign Application Priority Data

May 25, 1982 [GB] United Kingdom ..... 8215220

[51] Int. Cl.[3] ..... A44B 21/00

[52] U.S. Cl. ..... 24/295; 24/292; 24/293; 52/473; 248/72

[58] Field of Search ..... 24/292, 293, 294, 295; 248/228, 72; 52/473, 75, 78, 543; 403/387

[56] References Cited

U.S. PATENT DOCUMENTS

| | | | |
|---|---|---|---|
| 1,611,783 | 12/1926 | Schirmer | 403/387 |
| 2,305,122 | 12/1942 | Wiley | 24/295 |
| 3,004,307 | 10/1961 | Hallock | 52/473 |
| 3,673,643 | 7/1972 | Kindell | 24/295 |
| 3,808,646 | 5/1974 | Brumlik | 411/443 |
| 4,119,285 | 10/1978 | Bisping et al. | 248/72 |
| 4,266,385 | 5/1981 | Oehlert | 52/543 |

FOREIGN PATENT DOCUMENTS

| | | | |
|---|---|---|---|
| 1393346 | 5/1975 | Australia . | |
| 886979 | 7/1949 | Fed. Rep. of Germany | 24/295 |
| 1509433 | 8/1969 | Fed. Rep. of Germany | 52/473 |
| 1659422 | 8/1971 | Fed. Rep. of Germany . | |
| 2006780 | 10/1971 | Fed. Rep. of Germany . | |
| 2300026 | 7/1974 | Fed. Rep. of Germany . | |
| 2458640 | 1/1981 | France . | |
| 1037840 | 8/1966 | United Kingdom | 24/295 |
| 1389829 | 4/1975 | United Kingdom | 24/295 |

*Primary Examiner*—Victor N. Sakran
*Attorney, Agent, or Firm*—Pennie & Edmonds

[57] ABSTRACT

A clip for mounting a wall or ceiling panel structure having a plurality of panels in which the panels have inturned rims on their longitudinal edges and preferably beads on the rims. The clip has a body having downwardly extending first members preferably adjacent one edge and a downwardly extending fourth member preferably adjacent an opposite edge.

A second downwardly extending member having lateral lugs is adjacent and spaced from the first member by an amount to accommodate two rims. A pair of third downwardly extending members is shaped to enable two panels to be spaced from one another and is also provided with a lug so that the clip may alternatively be used for mounting a panel adjacent a wall surface.

10 Claims, 6 Drawing Figures

CLIP FOR WALL OR CEILING PANEL STRUCTURE

FIELD OF THE INVENTION

The present invention relates to a clip for a wall or ceiling panel structure.

BACKGROUND OF THE INVENTION

Various forms of panel structures have been proposed and one particular type is one in which the panels have inturned rims on their longitudinal edges and very often these rims have inturned beads on their free edges. The arrangement for fixing these panels to carriers, which are usually in the form of constant cross-section members, take many forms. Very often the carriers have flanges with portions cut out or punched out and into which either the rim or bead of a panel is inserted or a clip arrangement is inserted onto which the rim or bead is fixed.

While these arrangements are very satisfactory for specific use, they prove less useful for general application and for the do-it-yourself market.

Various proposals have been made to overcome these difficulties, as for example, those proposals disclosed in Austrian Specification No. 317503 and British Specification No. 1098613. However, these proposals are not entirely satisfactory in that they provide no facility for variation of the arrangement of the panel structure.

It is therefore an object of our invention to provide for a structure to secure panels to a carrier where the panel structure may be varied in its arrangement.

GENERAL DESCRIPTION OF THE INVENTION

Broadly, our invention relates to a clip for a wall or ceiling panel structure where the panels have inturned rims on longitudinal edges. The clip comprises a body attachable to a carrier and at least four laterally spaced downwardly extending retaining means on the body. First and fourth of the retaining means each have a retaining lug extending laterally inwardly therefrom. The second retaining means is laterally spaced from the first retaining means by an amount sufficient to allow two adjacent panels to be inserted in abutting relation between the first and second retaining means. The second retaining means has a lateral retaining lug directed towards the first retaining means and a further lateral retaining lug directed towards the third retaining means and spaced from the third retaining means by an amount to accommodate the rim of only one panel. The third retaining means is spaced from the fourth retaining means by an amount to accommodate only one panel.

The clip may be made readily as a molding from a plastics material and can be very inexpensive. The arrangement of the retaining means on the clip is such as to make it possible either to have the sides of the panels in a spaced apart relationship or in abutting relationship. Thus, if the panels are to be in abutting relationship, then the relevant inturned rims of two adjacent panels are held by the facing lateral lugs on the first and second retaining means, while if they are to be in spaced apart relationship, the respective inturned rims are held one between the third and fourth retaining means by the lug on the fourth retaining means and the other between the second and third retaining means by the lug on the second retaining means facing the third. Thus, the third retaining means in effect acts as a spacer and its dimension transverse to the panel length determines the actual spacing distance.

Means for attaching the body of the clip to the carrier can be one which enables the body to be slidable longitudinally of the carrier to take up any desired position. This greatly facilitates the mounting of the panel assembly. In the most convenient construction the body of the clip is attachable to the carrier by springing thereonto. Thus, upwardly extending members of the longitudinal edges of the clip can have inturned portions which clip over the carrier or some other simple spring-on device. Nevertheless any way of fixedly or displacably mounting the clip would be suitable under certain conditions.

Desirably, the first and fourth retaining means extend downwardly from the lateral edges of the body. This enables the clip to be used so that panels can be placed immediately adjacent a wall or ceiling surface at right angles to the main surface of the panels. Thus, if the clip is used for mounting a ceiling panel, the fourth retaining means will be placed in substantially abutting relationship to the wall of the room in question and it will only be the thickness of the fourth retaining means which will space the panel from the wall. Preferably then, the third retaining means has a lug extending laterally towards the fourth retaining means to provide the necessary retention on the bead of the rim.

In order to facilitate mounting and provide a more rigid structure, alternate ones of the retaining means comprise two longitudinally spaced members with the other alternate retaining means comprising a single member. Advantageously the two longitudinally spaced members of a retaining means are longitudinally spaced one on either longitudinal side of the retaining means adjacent thereto. Thus, with a single clip in position, one can mount a panel and because of the longitudinal spacing of alternate retaining means, this will be sufficient to "cantilever" the panel on a temporary basis until a subsequent clip is engaged. The choice of the number of members in each retaining means can be made to suit the particular requirement.

To facilitate mounting of the panels, the first, second and fourth retaining means are preferably capable of flexing laterally while the third may be formed of a substantially rigid material.

While the second retaining means may comprise a member or members with a lateral lug on each face, they may equally be formed as two parts, one of which has a laterally extending lug directed towards the first retaining means and the other which has a laterally extending lug directed towards the third retaining means. If desired the two parts of the second retaining means may be laterally or longitudinally spaced from one another.

The invention allows the choice, particularly to the do-it-yourself man, to have an "open" or "closed" panel system, even after he has purchased the clip.

DESCRIPTION OF THE PREFERRED EMBODIMENTS

Figure 1:
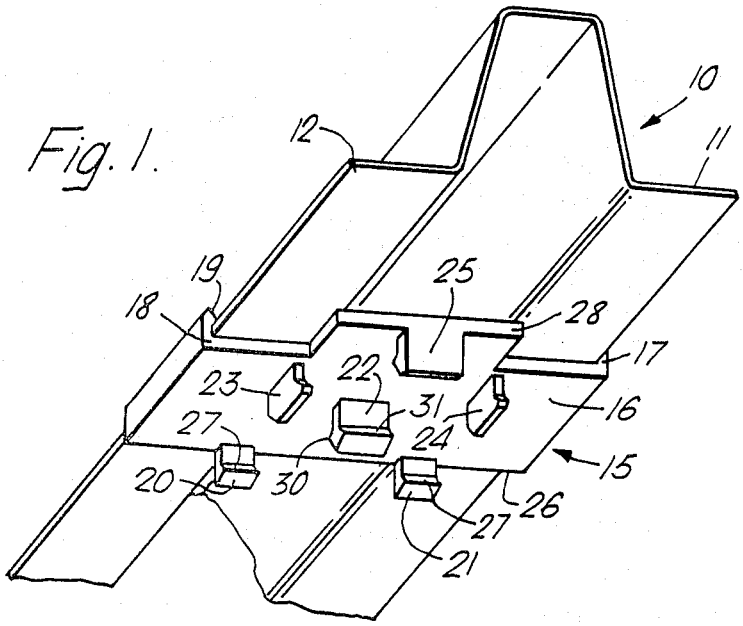
FIG. 1 is a bottom perspective view of a carrier of one embodiment of a clip according to the present invention mounted onto a carrier.
Figure 2:
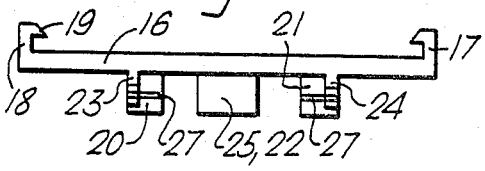
FIG. 2 is an end elevation of the clip of FIG. 1.

Referring to the clip of FIG. 1, there is illustrated a carrier 10 of generally "top hat" cross-section, having side flanges 11 and 12. The carrier is secured to a ceiling (or if desired to a wall) and a clip 15 according to the present invention is secured thereto. Referring to FIG. 2, it is seen that the clip includes a body 16 having two lateral upstanding members 17 and 18 with inturned portions spaced from the upper surface of the body 16 by an amount to accommodate the thickness of the flanges 11, 12.

From the lower surface of the clip as shown in FIG. 1, there are four retaining means in the form of six downwardly extending members, these being referred to herein as first members 20 and 21, the second member 22, third members 23 and 24 and a fourth member 25. While there have been shown two first members and two third members, there could be provided only one of these or there could be provided more of each of the members as well as any combination thereof.

Figure 3:
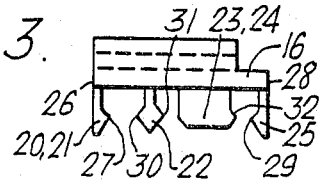
FIG. 3 is a side elevation of the clip shown in FIGS. 1 and 2.

Referring to FIG. 3 the actual form of these members is more readily seen.

The first members 20, 21 are disposed adjacent one lateral edge 26 of the body 16 and have inwardly directed lugs 27 thereon. Similarly the fourth member 25 extends downwardly from the lateral edge 28 of the body 16 and has an inwardly directed lug 29 thereon.

The second member 22 has a lug 30 facing the first members 20, 21 and a lug 31 facing the third members 23, 24.

All of the members 20, 21, 22, and 25 are laterally resilient so that they may flex laterally in one direction or the other. On the other hand, the third members 23, 24 are relatively rigid in the lateral sense and each carries a lug 32 facing the fourth member 25.

In use the clip is sprung onto the flanges 11 and 12 of the carrier 10 and is slidable along the length of the carrier to a desired location.

Figure 6:
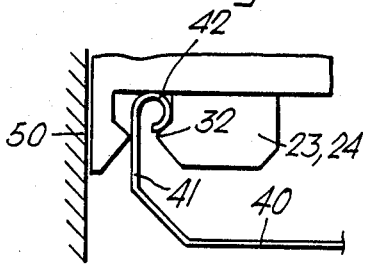
Figure 4:
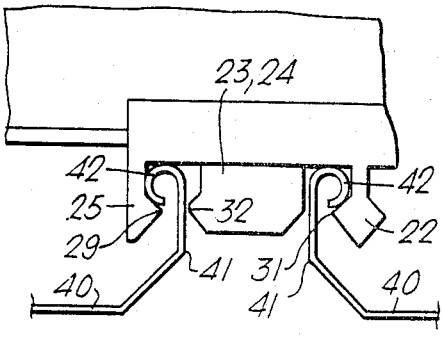
FIG. 4 is an end elevation showing the clip supporting two spaced panels.
Figure 5:
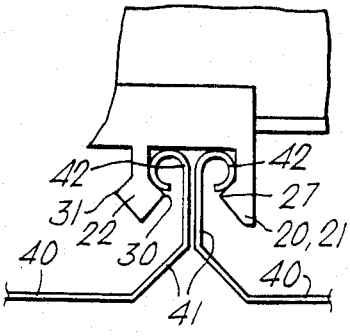
FIG. 5 is an end elevation showing the clip supporting two abutting panels; and, FIG. 6 is an end elevation showing the clip supporting a panel adjacent a wall.

FIGS. 4, 5 and 6 show one or more panels 40 each having an inturned rim 41 terminating in a rolled-over bead 42. The views in FIGS. 4, 5 and 6 show the clip from the opposite end from that of FIG. 3. The FIG. 4 construction is one in which the panels 40 are mounted so that their lateral rims 41 are spaced apart. The left-hand panel 49 therefore is clipped in the space between the members 25 and 23, 24, this space being just sufficient to accommodate only one inturned rim and bead. The spacing between the lugs 29, 32 is slightly less than the width of the bead 42 but the member 25 can spring outwardly to allow the bead to pass through and then spring back to hold it in place as shown.

The right-hand panel illustrated is accommodated between the second member 22 and the third members 23, 24, the rim 42 being just wider than the normal gap between the lug 31 and the members 23, 24, but the member 22 being able to spring away to allow for the passage as shown above. This will result in the panels being spaced apart as shown.

If the panels are to be mounted in abutting relationship as shown in FIG. 5, then the wider gap between the first members 20, 21 and the second member 22 is used. This gap is sufficient to accommodate two rims with their beads, the beads being held in place, after flexing outwardly of the members, by the lugs 27, 30.

If the assembly is to be mounted immediately adjacent to a wall surface 50 as shown in FIG. 6, then the clip is mounted to the carrier so that the fourth member 25 is substantially abutting the wall surface 50 and the bead 42 is held in place by the lug 32 on the third members 23, 24.

The provision of the two first members 20, 21 and two third members 23, 24 enables the panel to be supported temporarily by a single clip while other clips are positioned.

It will be seen that the construction of the present invention is particularly versatile enabling one to have the panels spaced apart or in abutting relation and enabling one to position a panel adjacent a further wall surface.

While the construction being described is for ceiling panels, equally it could be used for wall panels.

We claim:

1. A multipurpose panel structure clip for selectively mounting adjacent panels close together or in a spaced position to a carrier and where the panels have inturned rims on their longitudinal edges, said clip comprising a body adapted to be attached to a carrier and at least four laterally spaced downwardly extending retaining means on said body with the first and fourth of said retaining means each having a retaining lug extending laterally inwardly therefrom, with the second retaining means being laterally spaced from the first retaining means by an amount to allow two adjacent panels to be inserted in abutting relation between the first and second retaining means, with the second retaining means having a lateral retaining lug directed towards the first retaining means and a further lateral retaining lug directed towards the third retaining means and being spaced therefrom by an amount to accommodate the rim of only one panel, and with the third retaining means being spaced from the fourth retaining means by an amount to accommodate only one panel.

2. A clip according to claim 1 wherein said body is adapted to be slidably attached to the carrier to be displaceable longitudinally of the carrier.

3. A clip according to claim 1 wherein said body is adapted to be attached to the carrier by springing it thereonto.

4. A clip according to claim 1 wherein the first and fourth retaining means extend downwardly from the lateral edges of the body.

5. A clip according to claim 1 wherein alternate ones of said retaining means comprise two longitudinally spaced members, the other alternate retaining means comprising a single member.

6. A clip according to claim 1 wherein the third retaining means is formed of a substantially rigid material.

7. A clip according to claim 1 wherein the first, second and fourth retaining means are capable of flexing laterally.

8. A clip according to claim 1 wherein the third retaining means has a lug extending laterally towards the fourth retaining means.

9. A clip for a wall or ceiling panel structure having a plurality of panels in which the panels have inturned rims on their longitudinal edges, said clip comprising a body adapted to be attached to a carrier and at least four laterally spaced downwardly extending retaining means on said body with the first and fourth of said retaining means each having a retaining lug extending laterally inwardly therefrom, with the second retaining means being laterally spaced from the first retaining means by an amount to allow two adjacent panels to be inserted in abutting relation between the first and second retaining means, with the second retaining means having a lateral retaining lug directed towards the first retaining means and a further lateral retaining lug directed towards the third retaining means and being spaced therefrom by an amount to accommodate the rim of only one panel, with the third retaining means being spaced from the fourth retaining means by an amount to accommodate only one panel, wherein alternate ones of said retaining means comprise two longitudinally spaced members, the other alternate retaining means comprising a single member, and wherein the two longitudinally spaced members of a retaining means are longitudinally spaced one on each side of the member of the retaining means adjacent thereto.

10. A clip for a wall or ceiling panel structure having a plurality of panels in which the panels have inturned rims on their longitudinal edges, said clip comprising a body adapted to be attached to a carrier and at least four laterally spaced downwardly extending retaining means on said body with the first and fourth of said retining means each having a retaining lug extending laterally inwardly therefrom, with the second retaining means being laterally spaced from the first retaining means by an amount to allow two adjacent panels to be inserted in abutting relation between the first and second retaining means, with the second retaining means having a lateral retaining lug directed towards the first retaining means and a further lateral retaining lug directed towards the third retaining means and being spaced therefrom by an amount to accommodate the rim of only one panel, with the third retaining means being spaced from the fourth retaining means by an amount to accommodate only one panel, and wherein the second retaining means comprises two parts, one of which has a laterally extending lug directed towards the first retaining means and the other of which has a laterally extending lug directed towards the third retaining means.

* * * * *